United States Patent [19]

Watkiss

[11] Patent Number: 4,717,138

[45] Date of Patent: Jan. 5, 1988

[54] VALVE MECHANISM

[75] Inventor: Christopher R. Watkiss, Biggleswade, England

[73] Assignee: Watkiss Automation Limited, Bedfordshire, England

[21] Appl. No.: 866,196

[22] PCT Filed: Sep. 4, 1985

[86] PCT No.: PCT/GB85/00394

§ 371 Date: May 2, 1986

§ 102(e) Date: May 2, 1986

[87] PCT Pub. No.: WO86/01493

PCT Pub. Date: Mar. 13, 1986

[30] Foreign Application Priority Data

Sep. 4, 1984 [GB] United Kingdom ..... 8422338

[51] Int. Cl.[4] ..... B65H 3/08

[52] U.S. Cl. ..... 271/103; 271/107

[58] Field of Search ..... 271/106, 107, 102, 103, 271/94, 100; 294/61.4

[56] References Cited

U.S. PATENT DOCUMENTS

| | | | |
|---|---|---|---|
| 2,995,359 | 8/1961 | Gulick | 271/103 |
| 3,084,928 | 4/1963 | Opita | 271/106 |
| 4,327,906 | 5/1982 | Frohlich et al. | 271/103 |

FOREIGN PATENT DOCUMENTS

| | | | |
|---|---|---|---|
| 1176816 | 6/1961 | Fed. Rep. of Germany . | |
| 2263732 | 2/1974 | Fed. Rep. of Germany . | |
| 2633831 | 7/1976 | Fed. Rep. of Germany | 271/106 |
| 3016346 | 1/1981 | Fed. Rep. of Germany . | |
| 865376 | 4/1961 | United Kingdom . | |

*Primary Examiner*—Joseph J. Rolla
*Assistant Examiner*—Kenneth Noland
*Attorney, Agent, or Firm*—Seidel, Gonda, Goldhammer & Abbott

[57] ABSTRACT

A pneumatic valve mechanism, especially for controlling the movement of paper, comprises a mouthpiece (47) which defines an air intake (58), a bellows (10) coupled to the mouthpiece, a passage (42, 44) connecting the interior of the bellows to a pump so that when the bellows is not fully retracted suction is created at the air intake (58) and a seal (50) between the mouthpiece and a valve body (14) which is effective when the bellows is fully retracted, following closure of the air intake by a sheet of paper (60), to seal the air intake from the suction pump. Venting air can enter the mouthpiece in the retracted position of the bellows, to permit the sheet to drop off the intake, but without breaking the seal (50), whereby the bellows is maintained in its retracted position. The bellows (10) will only extend again to seek the next sheet when the effect created by the suction pump is interrupted, as by breaking the seal (50) by energizing a solenoid (64) and displacing a mechanical linkage (62,54).

10 Claims, 3 Drawing Figures

VALVE MECHANISM

Figure 1:
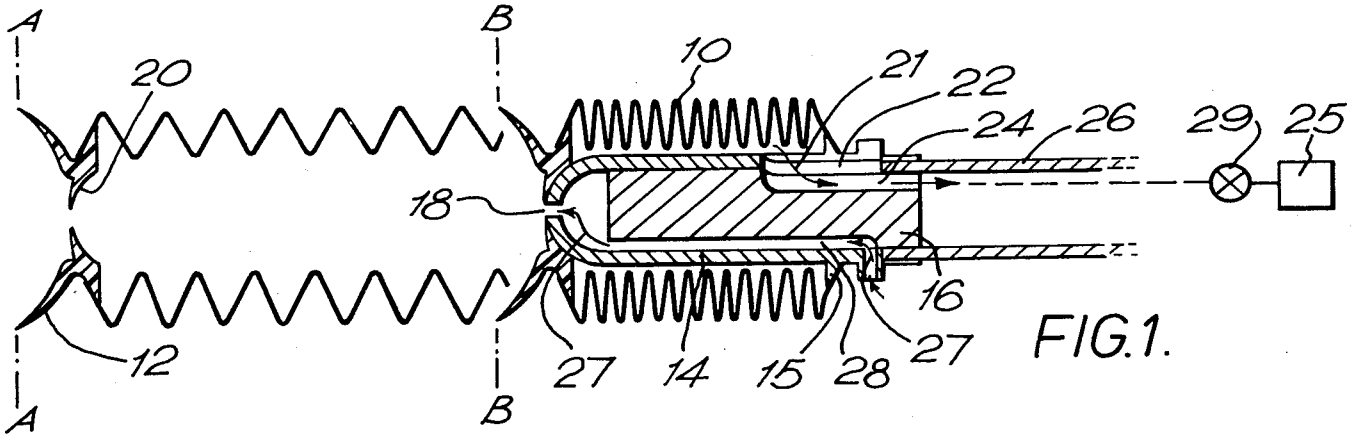

This invention relates to valve mechanisms, and is particularly concerned with a pneumatic valve mechanism which incorporates a bellows or like mechanism and which can be used especially for the controlled movement of sheets of paper, card or like material.

Various types of suction mechanism are known for use in moving sheets of paper or like material. More particularly, valved suction mechanisms are known, but these generally tend to be complex either in their construction, their manner of operation or their control.

It is an object of the present invention to provide a pneumatic valve mechanism which is extremely simple in its construction and manner of operation, yet by means of which one can achieve various desirable results in terms of the way in which sheets of material such as paper are controllably moved.

In accordance with the present invention there is provided a pneumatic valve mechanism comprising a mouthpiece which defines an air intake; an extensible and retractable sleeve coupled to the mouthpiece to cause the mouthpiece to move therewith; passage means to connect the interior of the sleeve to suction means such that when the sleeve is not fully retracted suction is created at the air intake; a seal between the mouthpiece and a valve body within the sleeve which is efective when the sleeve is fully retracted, following closure of the air intake, to seal the air intake from the suction means; venting means permitting air to enter the mouthpiece in the retracted position of the sleeve but without breaking the seal, whereby the sleeve is maintained in its retracted position; and actuating means arranged upon operation to break the seal and cause the sleeve to extend.

Preferably, the sleeve is a bellows.

The mouthpiece preferably comprises a suction cup. In a preferred embodiment of the invention the mouthpiece comprises a sucker which collapses eccentrically when it makes contact with a sheet of paper, thereby to enable one to lift an edge or corner of the sheet and initiate a peeling action instead of exerting a direct pull on the sheet.

Although the valve mechanism of the present invention preferably uses a straight sleeve, e.g. bellows, which is extensible and retractable along a rectilinear axis, the valve mechanism of the invention can alternatively use a sleeve mechanism which is designed to move or is constrained to move in an arcuate direction.

With the valve mechanism of the present invention, when a sheet of paper comes to overlie the air intake, the mouthpiece grips the paper and the cutting off of the air flow through the intake causes the sleeve to be retracted. Retraction of the sleeve causes the mouthpiece also to retract towards the valve body, creating the seal, whereupon the venting means is effective to cause the paper to be released from the intake, although the suction means continues to hold the sleeve in the retracted state.

The mode of operation of this mechanism means that a sheet of paper or like material is grasped by the mouthpiece, movement is imparted to it in a predetermined direction for a short time, and thereafter the grip on the paper is released with the valve mechanism remaining retracted, i.e. out of the way. It is only upon an interruption of the effect created by the suction means that the sleeve can extend again to seek another sheet of paper. This interrupting can be achieved for example by switching the suction means off and on, or, preferably, by breaking the seal electromechanically, for example by the use of a solenoid and mechanical linkage. The latter offers greater flexibility and ease of control, particularly if the valve mechanism is part of a computer-controlled system.

Depending upon how the mouthpiece, or indeed mouthpieces, is/are positioned in relation to the sleeve, one can exert different forms of control on the movement of the paper which is grasped at the air intake. For example, one can use the valve mechanism simply to move a sheet of paper substantially linearly in a flowing manner, moving the paper either from a stack to another location within a piece of equipment, or continuing its motion through a piece of apparatus. In an alternative arrangement, the valve mechanism of the present invention can be used to open up folded sheets of paper or like material so that the folded sheet is opened sufficiently for it reliably to be laid over a collecting element, such as a bar. This has particular application to the field of collating folded sheets for subsequent stitching and binding for example. The valve mechanism of the present invention will find application in many areas of the paper-handling art, as will be readily apparent to those skilled in that art.

In order that the invention may be more fully understood, a number of embodiments of valve mechanism in accordance with the invention will now be described by way of example, and with reference to the accompanying drawings.

Figure 2:
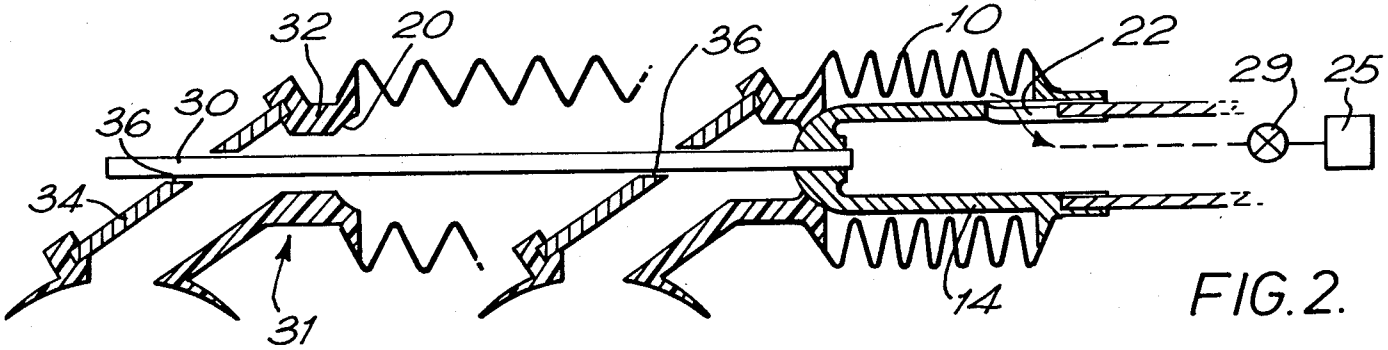
Figure 3:
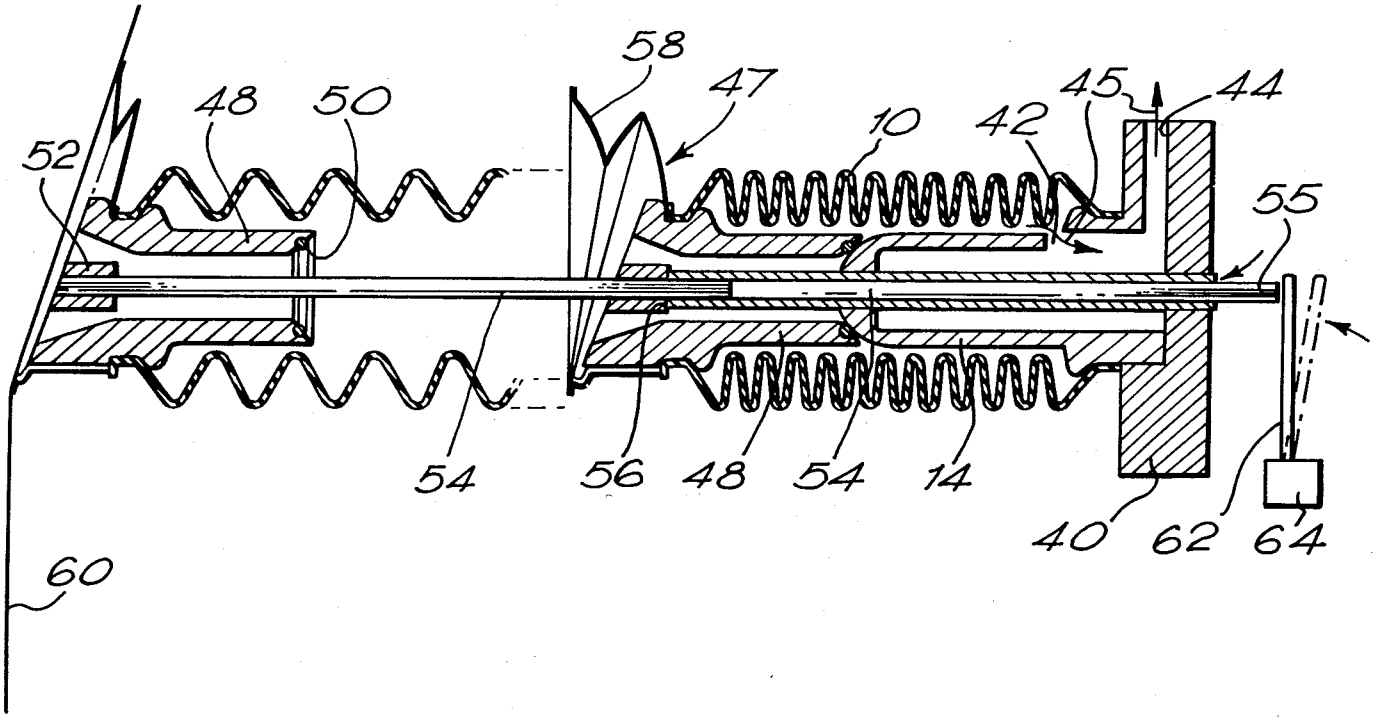

In the drawings:

FIG. 1 is a longitudinal sectional view through a first embodiment of pneumatic valve mechanism, the drawing showing the positions of the valve elements both with the bellows extended and with the bellows retracted;

FIG. 2 is a similar longitudinal sectional view through a second embodiment of valve mechanism, again with the left-hand part of the drawing showing the elements as positioned with the bellows extended, and the right-hand half of the drawing showing those elements as positioned with the bellows retracted; and FIG. 3 is a similar longitudinal sectional view through a third embodiment of valve mechanism, again showing the positions of the elements with the bellows extended and retracted.

Referring first to FIG. 1, the pneumatic valve comprises an extensible and retractable sleeve in the form of a bellows 10 having a suction cup 12, which constitutes a mouthpiece, mounted fixedly at one end thereof. Within the other end of the bellows 10 there is fixedly mounted a two-part valve body comprising an outer valve member !4 and an inner plug 16. The valve member 14 is provided with a circumferential flange 15 to which the end of the bellows 10 is secured. The forward end of the valve member 14 which extends into the bellows is rounded and is provided with a central hole 18 therethrough. The curvature of the rounded end of the valve member 14 is matched to a curved internal surface 20 of the suction cup 12 so that, as shown in the right-hand half of FIG. 1, these two surfaces form a seal when seated one against the other. The valve body comprising the member 14 and plug 16 defines two independent air-ways. One air-way, as indicated by arrow 21, extends from around the valve member 14, through a slot 22 in the valve member, and through an axially extending channel 24 in the plug 16 to a pipe 26 which is connected to a pump 25 or like device to create a reduced air pressure within the bellows 10. This device 25 is herein referred to as a vacuum source, although the pump or like device creates a reduced air pressure or suction air flow, not of course a true vacuum. The other air-way defined by the valve body is a venting passageway, indicated by arrows 27, defined by a channel 28 formed axially along the length of the plug 16 which communicates at one end with the hole 18 at the forward end of the valve member 14 and at the other end with the ambient air.

In operation, with the vacuum source switched on, when the valve mechanism is to pick up a sheet of paper or like material, the bellows 10 is triggered to extend from its retracted position towards the position A—A of maximum extension indicated at the left-hand side of FIG. 1. The vacuum source functions to draw air in through the air intake defined by the suction cup 12. As soon as a sheet of paper overlies the cup 12, i.e. as soon as the suction cup finds a sheet or as soon as a sheet is presented to the suction cup, whether at the position A—A or before, the flow of air in through the cup ceases and the vacuum source causes the paper to be gripped by the cup and the bellows to be fully retracted to the position corresponding to the cup intake lying in the plane defined by the line B—B. When the bellows 10 is retracted to this position, with the cup still holding the sheet, the surface 20 of the cup seats against the forward end of the valve member 14 and forms a seal which immediately cuts off the vacuum source from the interior of the cup 12. This, in combination with the venting action through the hole 18, causes the sheet to drop away from the suction cup 12. However, the release of the sheet from the grip of the cup is not accompanied by a return of the bellows 10 to its extended position. It is maintained in its retracted position by the continuing effect of the vacuum source and by virtue of the seal between the cup 12 and the valve member 14. The bellows 10 will only return to an extended position to seek a new sheet when the seal is broken by interruption of the suction effect created by the vacuum source. That effect can conveniently be interrupted in this embodiment by switching the vacuum source off and on again, as indicated schematically in FIG. 1 by a switch 29 which constitutes an actuating means.

Referring now to FIG. 2, this shows a modified form of pneumatic valve mechanism. In this embodiment the valve body comprises only the valve member 14, and the plug is omitted. In this embodiment the whole of the interior of the valve member 14 is in communication with the vacuum source 25, although there is no hole in the valve member at its forward end. Instead, an elongate rod 30 is fixedly secured to the forward end of the valve member 14 and extends longitudinally of the valve mechanism. In this embodiment the suction cup 12 is turned through 90° as compared with its orientation in the embodiment shown in FIG. 1. The suction cup 12 is positioned at one end of a mouthpiece 31 which comprises a moulding of plastics material which incorporates both the suction cup 12 and also a seat portion 32 which defines the internal curved surface 20 to seat against and seal the curved forward end of the valve member 14. The mouthpiece 31 also incorporates a plate 34 which is perforated by a hole 36 so that the rod 30 can extend therethrough and slide back and forth in relation to the hole 36 in the plate 34. The hole 36 in the plate 34 is made sufficiently large for it to act as a venting hole in communication with the interior of the cup 12.

The manner of operation of this second embodiment is similar to that described above in connection with FIG. 1, except that in this case the suction cup 12, being turned through 90°, can exert a different pulling movement on a sheet of paper. The embodiment shown in FIG. 2 is more appropriate for generating a movement of a sheet whereby the sheet is moved in its own plane. The rod 30 can be omitted if desired, leaving just a venting hole 36 in the mouthpiece 31. The rod 30 does exert a guiding action on the movement of the mouthpiece and bellows and can also be used to exert a guiding function on an associated stack of sheets of material which are to be moved under the control of the valve mechanism. When the bellows 10 of the valve mechanism is in its retracted position, the rod 30 extends substantially beyond the forward end of the valve mechanism and can thus be used to guide and control either a stack of sheets or a mechanism associated therewith.

FIG. 3 shows a third, and preferred, embodiment of valve mechanism in accordance with the invention. Here again the valve member 14 is secured to one end of the bellows 10. The valve member 14 is fixedly mounted in a base 40. The valve member is provided with a hole 42 which communicates both with the interior of the bellows and also with a passageway 44 which is connected to a vacuum source (not shown) such as a pump. Arrows 45 indicate the suction air flow out of the compartment or chamber defined by these components. A hollow guide tube 46 extends axially through the valve member 14 and is secured at its one end in the base 40.

Secured to the forward end of the bellows 10 and displaceable with the bellows, is a mouthpiece, indicated generally at 47. The mouthpiece comprises a generally cylindrical tube 48 which is curved or tapered or otherwise shaped at its rearward end and there carries a sealing member 50. As can be seen from the right-hand half of FIG. 3, the sealing member 50 forms a seal with the rounded forward end of the valve member 14 when the bellows 10 is fully retracted. Mounted centrally within the axial bore through the tube 48 is a socket 52 which holds one end of a guide rod 54 which is received at its other end in the guide tube 46. When the mouthpiece is at its fully extended position the rear end of the guide rod 54 is still within the end of the guide tube 46, and when the bellows is fully retracted the rear end of the guide rod 54, as shown, projects out of the rear end of the guide tube 46. The guide rod 54 is provided with a surface groove or grooves 55 or is dimensioned in relation to the internal diameter of the guide tube 46 so that there is a venting passageway between guide rod and guide tube from where the guide rod exits from the rear of the guide tube forwards to where the socket 52 abuts against the forward end of the guide tube 46. Radial holes or slots 56 are provided at the forward end of the guide tube 46 to complete the venting passage to the mouthpiece.

In this embodiment the forward end of the mouthpiece tube 48 is set at an inclined angle and the air intake proper is defined by a removable boot 58 which fits over the end of the tube. This boot 58 is made of a relatively soft material and is shaped and folded so that it will collapse eccentrically when it comes into contact with a sheet of paper, as shown at the left-hand side of FIG. 3 where the sheet of paper is indicated at 60. This initiates a peeling action which means that one can lift a corner or edge of a sheet instead of exerting a direct tractive force at right-angles to the plane of the paper sheet.

With this valve mechanism the suction effect exerted by the pump on the interior of the bellows is continuous and is not interrupted in order thereby to enable the mouthpiece to seek out another sheet. Instead, the seal at 50 is broken by electromechanical means. A movable arm 62 controlled by a solenoid 64 is positioned so that when the solenoid is energised the arm will strike the end of the guide rod 54, pushing the whole mouthpiece forward and breaking the seal. The bellows 10 then immediately extends, until the air intake is shut off by the boot 58 contacting the next sheet.

It should be appreciated that with the valve mechanism of the present invention the mouthpiece will pick up a sheet of paper regardless of where the sheet is positioned between the limits A—A and B—B (FIG. 1). The air intake is effective throughout the extension phase of the bellows movement. Maintaining the bellows retracted until the actuating means is triggered is also advantageous, in that access to the zone in front of the mouthpiece is unimpeded.

The seal between the mouthpiece and valve body may comprise an actual sealing element or may be achieved just by the engagement of the two parts if the materials, shapes and dimensions are appropriate.

Although the pneumatic valve mechanism of the present invention has wide application to all aspects of the handling of sheet material, it is particularly useful in conjunction with collating machines. For example, a plurality of such valve mechanisms can be used in conjunction with a rank of linearly arranged stations at each of which a stack of sheets of material, such as paper, is positioned. The top sheet of each stack can be readied for onward movement, and when detector means indicate that a sheet is ready in each station then the valve mechanisms can be actuated to move the sheets simultaneously or sequentially from the respective stations with the valve mechanisms remaining retracted out of the way after advance of the sheets.

I claim:

1. A pneumatic valve mechanism comprising a mouthpiece which defines an air intake; an extensible and retractable sleeve, normally biased at an extended position, coupled to the mouthpiece to cause the mouthpiece to move therewith; passage means to connect the interior of the sleeves to suction means such that when the sleeve is not fully retracted suction is created at the air intake; wherein, when the air intake is closed, the sleeve is retracted by the effect of the suction; a seal between the mouthpiece and a valve body within the sleeve which is effective when the sleeve is fully retracted, following closure of the air intake, to seal the air intake from the suction means; venting means permitting air to enter the mouthpiece in the retracted position of the sleeve without breaking the seal, whereby the sleeve is maintained in its retracted position by the effect of said suction; and actuating means arranged upon operation to break the seal and thereby permit the biased sleeve to return towards its extended position.

2. A valve mechanism as claimed in claim 1, in which the extensible and retractable sleeve is a bellows.

3. A valve mechanism as claimed in claim 1 or 2, in which the mouthpiece comprises a suction cup.

4. A valve mechanism as claimed in claim 3, in which the suction cup itself defines a sealing surface engageable with the valve body to form the seal.

5. A valve mechanism as claimed in claim 3, in which the mouthpiece comprises a generally tubular member having the suction cup at one end thereof and sealing means at the other end thereof.

6. A valve mechanism as claimed in claim 5, in which a guide rod extends from the valve body through and out of the mouthpiece, the venting means comprising an aperture in the mouthpiece around the guide rod.

7. A valve mechanism as claimed in claim 5, in which the mouthpiece includes a guide rod movable with the tubular member and extending longitudinally through the bore thereof, the guide rod being received at its other end in a guide tube rigidly connected to the valve body, the venting means comprising a passageway between the guide rod and the guide tube.

8. A valve mechanism as recited in claim 1, in which the mouthpiece comprises a boot which defines the ar intake and which is shaped to collapse eccentrically when it comes into contact with and grips a sheet of material, thereby initiating a peeling movement of the sheet.

9. A valve mechanism as recited in claim 1, in which said actuating means comprises switching means arranged to interrupt the effect of the section means.

10. A valve mechanism as recited in claim 1, in which said actuating means comprises electromagnetic means arranged to control movement of a mechanical linkage, displacement of which causes the seal to be broken.

* * * * *